US012673250B2

(12) United States Patent
Lay

(10) Patent No.: US 12,673,250 B2
(45) Date of Patent: Jul. 7, 2026

(54) SNAG-FREE EYELET ANCHOR

(71) Applicant: William Coleman Lay, St. George, UT (US)

(72) Inventor: William Coleman Lay, St. George, UT (US)

( * ) Notice: Subject to any disclaimer, the term of this patent is extended or adjusted under 35 U.S.C. 154(b) by 253 days.

(21) Appl. No.: 18/085,223

(22) Filed: Dec. 20, 2022

(65) Prior Publication Data

US 2024/0198201 A1 Jun. 20, 2024

(51) Int. Cl.
*A63B 67/00* (2006.01)
*A63B 71/02* (2006.01)

(52) U.S. Cl.
CPC ..... *A63B 71/022* (2013.01); *A63B 71/023* (2013.01); *A63B 2071/024* (2013.01)

(58) Field of Classification Search
CPC ..... A63B 71/022; A63B 71/023; A63B 2071/024
USPC ..... 473/421
See application file for complete search history.

(56) References Cited

U.S. PATENT DOCUMENTS 2,289,818 A * 7/1942 Winner ..... A63C 11/221 403/109.5
4,098,503 A * 7/1978 Antone ..... A63B 59/50 473/457
4,288,102 A * 9/1981 Ramer ..... A63C 11/222 280/821
4,365,808 A * 12/1982 Perez ..... F41B 15/06 463/47.4
4,423,868 A * 1/1984 Younts ..... A63B 60/06 473/564
4,576,395 A * 3/1986 Longoria ..... B60R 9/06 224/520
4,809,975 A * 3/1989 Lee ..... A63B 69/36 473/256
5,041,951 A * 8/1991 Fan ..... F41B 15/04 463/47.7
8,172,703 B2 5/2012 Lay
8,496,545 B2 7/2013 Lay
8,747,259 B2 6/2014 Lay
10,844,625 B2 11/2020 Annas
10,933,294 B2 3/2021 Colling
11,154,763 B1 10/2021 Lay
11,235,216 B1 2/2022 Dickerson et al.
2021/0032897 A1 2/2021 Hutnak
2021/0178243 A1 6/2021 Colling et al.
2021/0299532 A1 9/2021 Chee
2022/0001226 A1* 1/2022 Chen ..... A63B 71/022 473/473
2022/0062733 A1 3/2022 Thornton et al.
2022/0355180 A1 11/2022 Colling et al.

* cited by examiner

*Primary Examiner* — Mitra Aryanpour
(74) *Attorney, Agent, or Firm* — Madson IP. P.C.

(57) ABSTRACT

A snag-free eyelet anchor has an elongate, low-profile arc shape that provides reduction or elimination of snagging situations with netting and other snag-prone materials used with various frameworks such as recreational equipment, and more specifically, collapsible sports enclosures, including batting cages.

4 Claims, 9 Drawing Sheets

SNAG-FREE EYELET ANCHOR

BACKGROUND OF THE INVENTION

1. Field of the Invention

The present invention relates to specialty anchors, and more particularly, to a snag-free eyelet anchor being suitable for the securement of netting or other snag-prone materials. Additionally, the present disclosure relates to the field of recreational equipment, and more specifically, to collapsible sports enclosures, including batting cages.

2. The Relevant Technology

In many sporting events players participate by pitching, hitting, catching, and/or kicking. During training, such players practice within specialized enclosures such as batting cages, driving ranges, bullpen enclosures, and the like that are enclosed by netting or other snag-prone materials. Such enclosures encounter a variety of forces created by wind, tension, and impacts caused by moving projectiles such as baseballs, softballs, tennis balls, footballs, volleyballs, basketballs, and many other types of moving projectiles. In addition, other recreational structures such as tents, windshielding barriers, hunting blinds, and the like that are comprised of snag-prone materials may encounter similar forces caused by wind and weather.

Consequently, such enclosures and recreational structures frequently are beset with wear and tear challenges. When the netting or snag-prone materials snag on the enclosure's structural frame or securing structure that holds and shapes the netting or other materials, tears and detachment can occur, rendering them less effective or unusable. Replacement of the netting or the other material may be difficult or unavailable, requiring the entire enclosure or structure to be replaced.

As a result, anything that reduces or eliminates the snags may significantly advance the useful life of the enclosure or structure and/or the costs of replacement over time. Accordingly, a need exists for snag-reduction and/or snag-elimination. Specifically, a new snag-free eyelet is disclosed herein.

BRIEF SUMMARY OF THE INVENTION

The present invention has been developed in response to the present state of the art, and in response to the problems and needs in the art that have not yet been fully solved and is not currently available. The present invention provides a new snag-free eyelet that may act as an anchor to which the netting, the other material, and/or structural elements (such as guy lines or guide ropes) may be attached.

The snag-free eyelet of the present invention comprises an elongated, arc-shaped body having attachment ends that is attached to a framework element such that an opening having a height sufficient to accept therethrough an anchoring member such as a guide rope or a guy line. In some embodiments the snag-free eyelet is attached to a coupler sleeve that has a longitudinal axis and the snag-free eyelet is oriented to align longitudinally with the longitudinal axis. When so aligned the snag-free eyelet may provide reinforcement against bending forces.

These and other features of the present invention will become more fully apparent from the following description or may be learned by the practice of the invention as set forth hereinafter.

BRIEF DESCRIPTION OF THE DRAWINGS

For the above-recited and other features and advantages of the invention to be readily understood, a more particular description of the invention briefly described above will be rendered by reference to specific embodiments thereof which are depicted or illustrated in the appended figures. Understanding that these depictions and drawings show only typical embodiments of the invention and should not be considered limiting of its scope, the invention will be described and explained with additional specificity and detail with reference to the accompanying figures in which:

FIG. 1A depicts the prior art batting cage framework showing rope rings positionally attached to the framework to receive exemplary guide ropes that support and reinforce the shape of the framework. FIG. 1B shows netting draped over the framework and resting on the guide ropes to form a batting cage enclosure and a region called out in phantom lines as region 1D. FIG. 1C shows netting draped over the framework and the framework secured by guy lines staked into the ground. FIG. 1D is an enlarged region of the batting cage enclosure of FIG. 1B showing a misoriented rope ring.

FIG. 8A depicts the batting cage framework showing snag-free eyelet anchors positionally attached to the framework to receive exemplary guide ropes that support and reinforce the shape of the framework. FIG. 8B shows netting draped over the framework and resting on the guide ropes to form a batting cage enclosure.

REFERENCE NUMBERS

Figure 1A:
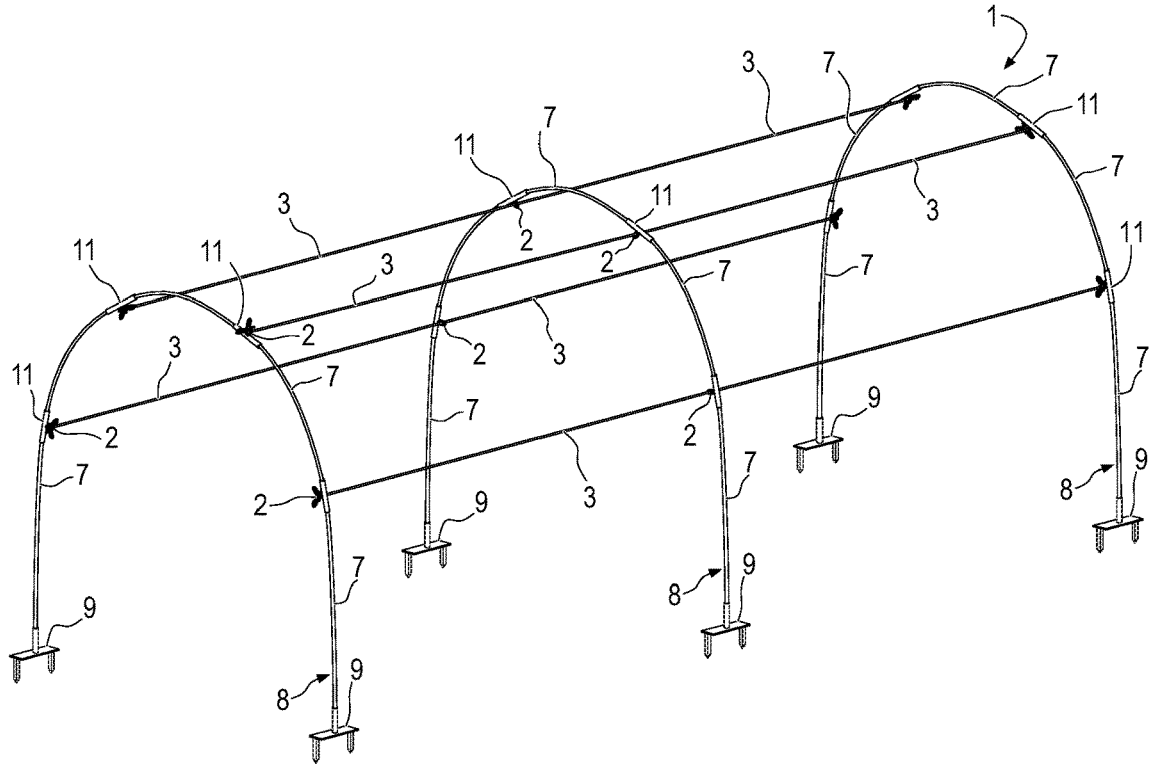
FIG. 1A (Prior Art)
FIGS. 1A-D include perspective views of an exemplary prior art batting cage framework during three stages of assembly.

| | |
|---|---|
| batting cage framework or framework 1 | rope rings 2 |
| guide rope(s) 3 | netting or net 4 |
| batting cage enclosure 5 | guy line(s) 6 |
| frame pole(s) 7 | archway(s) 8 |
| ground anchor(s) 9 | stake 10 |
| coupler sleeve 11 | |
| frame poles 17 | coupler sleeve 21 |
| snag-free eyelet anchor or eyelet anchor 22 | coupling end 24 |
| opening 26 | receiving recess 28 |
| batting cage framework or framework 30 | guide rope(s) 32 |
| netting or net 34 | batting cage enclosure 36 |
| archway(s) 38 | |
| Arrows A | Height H |

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the present invention, as represented in the Figure(s), is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

There are many types of specialized enclosures and recreational structures that are enclosed or covered by netting or lightweight materials that tend to be snag prone. With netting and lightweight materials that are snag prone, snagging may severely compromise the efficacy of the netting or lightweight material in performing its intended purpose (such as keeping or restraining projectiles within or from escaping an enclosure). Enclosures such as batting cages, bullpen enclosures, golf driving ranges, and the like encounter a variety of forces created by wind, tension, and impacts caused by moving projectiles such as baseballs, softballs, tennis balls, footballs, volleyballs, basketballs, and many other types of moving projectiles. Additionally, other recreational structures such as tents, wind-shielding barriers, hunting blinds, and the like that are comprised of snag-prone materials may encounter similar forces caused by wind and weather and inadvertent snagging by equipment or user.

Such enclosures and structures need protection against snagging that leads to tearing or shredding of the netting or materials. Measures have been taken in the past to reduce or eliminate snagging. The invention of the present disclosure is an added measure that may be taken in many different situations to reduce or eliminate snagging. Obviously, every different situation should not be described in this disclosure when a representative example will sufficiently teach the invention and how it is used for not only the representative example but for many other uses that will be readily apparent to those of ordinary skill in the art who have been informed and taught by this disclosure. Consequently, for the sake of brevity and without compromising or limiting the teachings herein, the invention of this disclosure will be described in reference to an exemplary, representative batting cage enclosure. Thus, the following detailed description of the embodiments of the representative example(s) of the present invention, as depicted in the Figure(s), is not intended to limit the scope of the invention, as claimed, but is merely representative of one of many presently preferred embodiments of the invention.

Figure 1B:
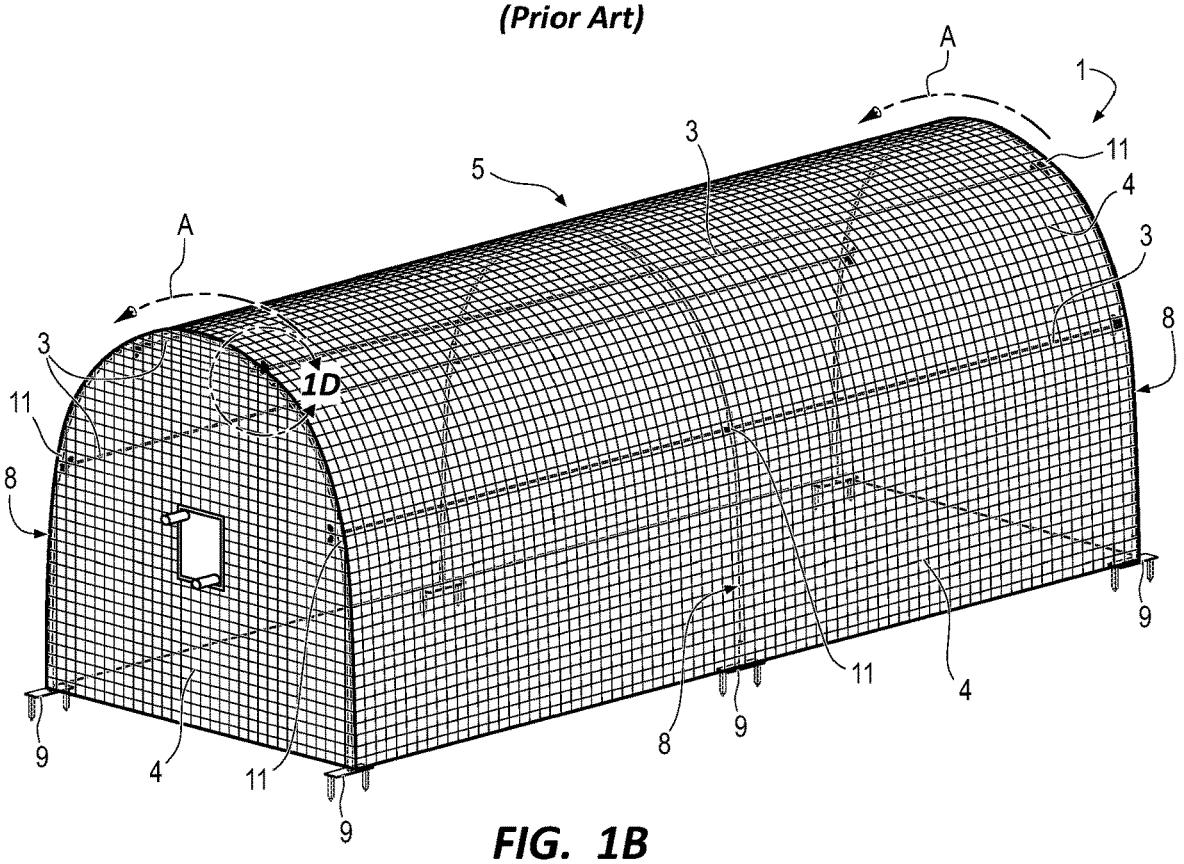
FIG. 1B (Prior Art)
Figure 1C:
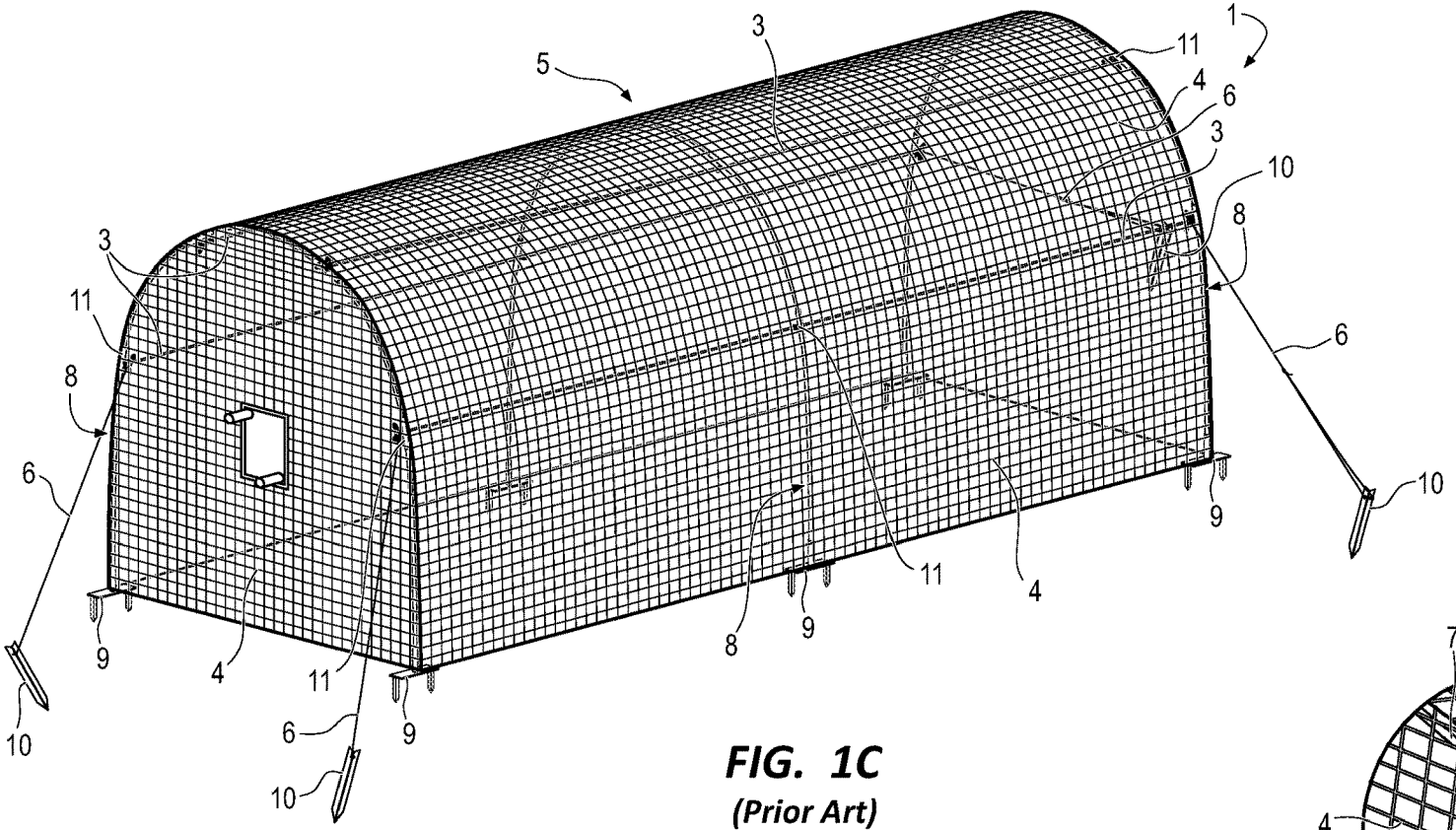
FIG. 1C (Prior Art)
Figure 1D:
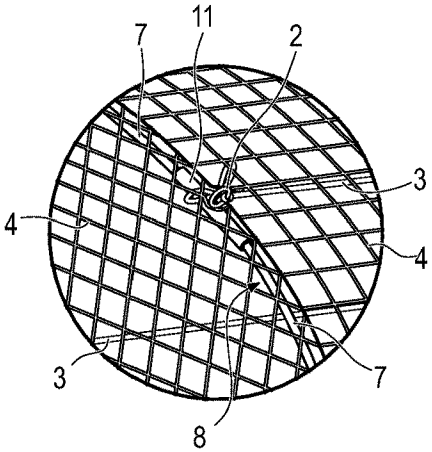

FIGS. 1A-D are perspective views of an exemplary prior art batting cage framework 1 depicted at three different stages of assembly. FIG. 1A depicts the prior art batting cage framework 1 showing rope rings 2 positionally attached to the framework 1 to receive exemplary guide ropes 3 that support and reinforce the shape of the framework 1. FIG. 1B shows netting 4 draped over the framework 1 and resting on the guide ropes 3 to form a batting cage enclosure 5 and a region called out in phantom lines as region 1D. FIG. 1C shows netting 4 draped over the framework 1 and the framework 1 secured by guy lines 6 staked into the ground. FIG. 1D is an enlarged region of the batting cage enclosure of FIG. 1B showing a misoriented rope ring 2.

The framework of FIG. 1A comprises an assembly of flexible frame poles 7 connected to form multiple archways 8 that may be anchored into the ground using ground anchors 9. Each archway 8 of connected flexible frame poles 7 is bent into an arch and the ends of the arch are secured within the ground anchors 9 which are driven into the ground so that each archway 8 is spaced from adjacent archway 8 a predetermined distance. The predetermined distance depends on the number of archways 8 and the length intended for the framework 1.

Because the frame poles 7 are flexible, the archways 8 are also flexible. To maintain the overall structural shape of the framework 1, guide ropes are secured to the rope rings 2 so that the guide ropes 3 are taut, as shown in FIG. 1. Consequently, the guide ropes 3 serve as longitudinal support structure and the archways 8 serve as transverse support structure for supporting a cover such as the netting 4. Although the framework 1, as depicted in FIG. 1, will have some longitudinal play and some transverse play when encountered by certain forces, the framework 1 will generally maintain its overall shape and return to its upright shape once the force is removed.

FIG. 1B depicts the netting 4 as fully deployed after being drown over the framework 1 in the direction of Arrows A. With this prior art embodiment, the netting 4 merely drapes over the framework 1 to enclose the framework 1, form the batting cage enclosure 5. The overall weight of the netting 4 holds the netting against the framework 1 so that the netting need not be secured directly to the framework 1. Draping of the netting 4 is another way to reduce snagging of the netting 4. Netting 4 that is tied or otherwise secured directly to the framework 1 tends to rub and tear in the location of the fastening, because the netting 4 is not free to move in reaction to the wind or the impact by a ball or some other projectile to absorb the force encountered.

To stabilize and minimize undesired movement of the framework 1 longitudinally or transversely due to forces applied either from the exterior (such as wind or some object falling against or onto the framework 1) or from the inside (such as projectile impact or a user leaning against an archway 8), guy lines 6 are secured to rope rings 2 at one end and to a stake 10 driven into the ground at the other end, as depicted in FIG. 1C. The guy lines 6 are drawn taut to provide stability and to maximize the interior volume of the framework 1.

To avoid unnecessary snagging, rope rings 2 are oriented inwardly from the framework 1. However, by way of example, one rope ring 2 is depicted as being oriented outwardly in each of FIGS. 1A-1C. Such orientation may be due to mistakenly misorienting the rope ring 2 during assembly of the framework 1 or may be due to undesired rotation of the rope ring 2 during use of the batting cage enclosure 5 (much like vibration or repeated impacts may cause a bolt to loosen). A misoriented rope ring 2 as better shown in FIG. 1D may pose a significant snag risk.

Figure 2:
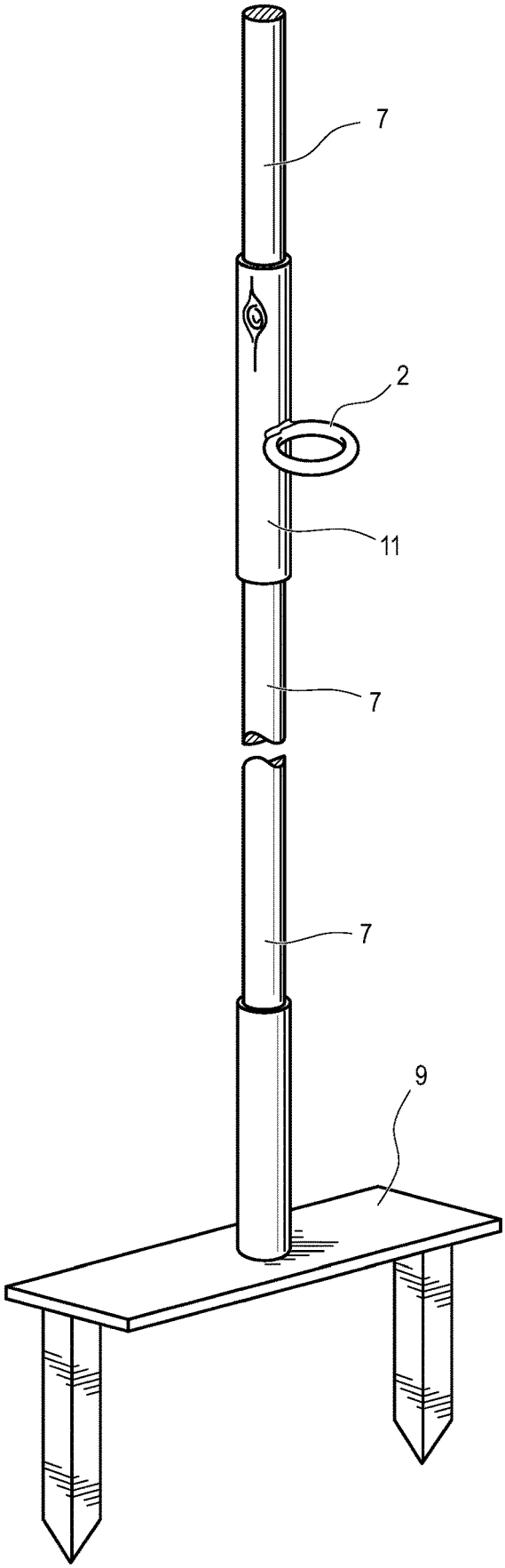
FIG. 2 (Prior Art)
FIG. 2 is an elevational view of an exemplary prior art flexible frame pole with a coupler sleeve having an attached rope ring, wherein the frame pole is secured to a ground anchor and another flexible frame pole.

FIG. 2 is an elevational view of an exemplary prior art flexible frame pole 7 with a coupler sleeve 11 having an attached rope ring 2, wherein the frame pole 7 is secured to a ground anchor 9 and another flexible frame pole 7 that may or may not have a rope ring 2. As depicted, rope ring 2 is not an eye bolt, but rather is secured directly to coupler sleeve 11 by welding or some other sufficiently strong bonding. Eye bolts are infrequently used on batting cage enclosures because they tend to present a serious health risk and snag risk because the threads and nut used to secure the eye bolt may protrude becoming scratch or cut risks to skin and clothing and snag risks to netting 4.

Figure 3:
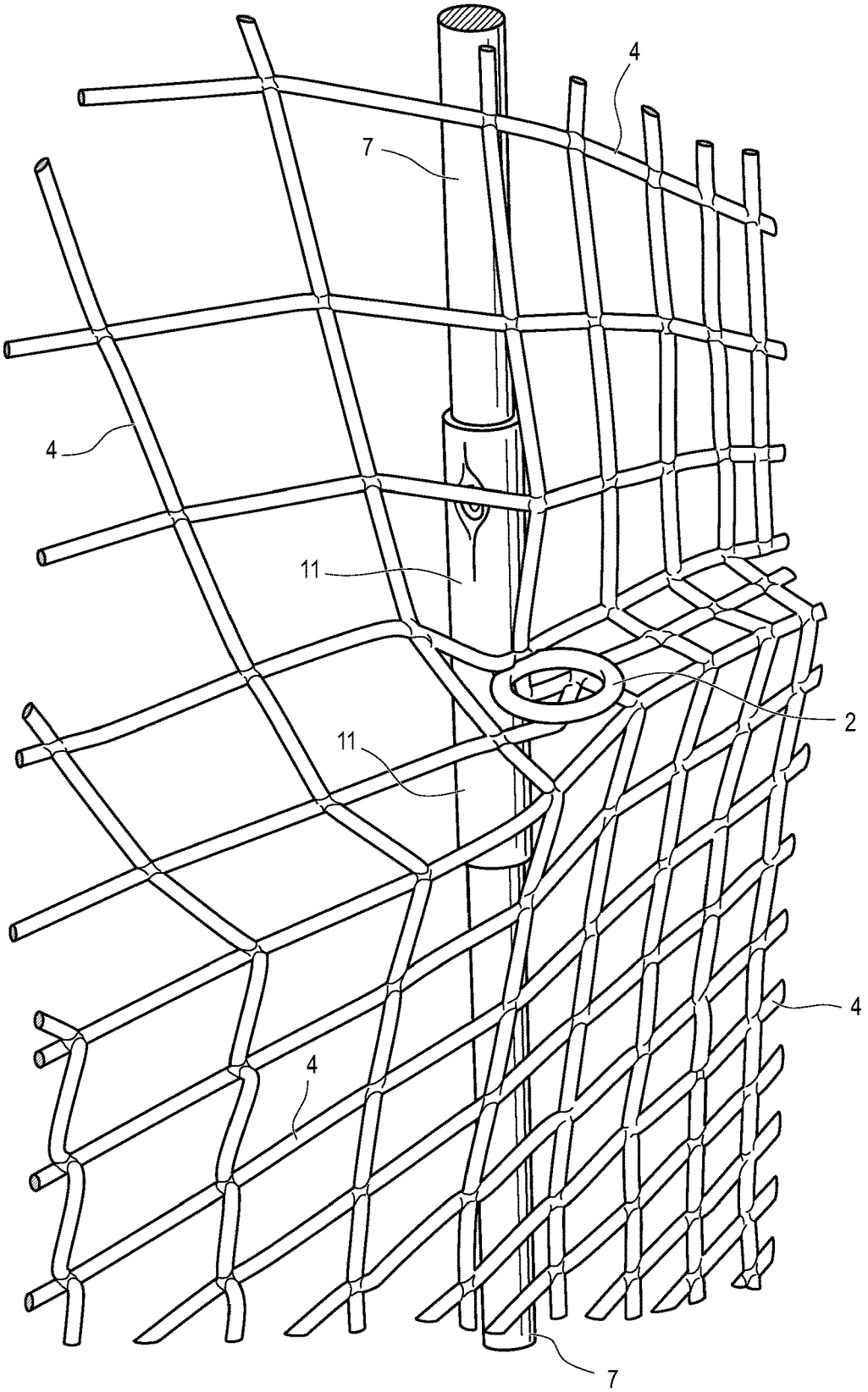
FIG. 3 (Prior Art)
FIG. 3 is a perspective view of an exemplary prior art flexible frame pole assembly having a coupler sleeve having an attached rope ring depicting how force on a net may cause the netting to snag on the rope ring.

FIG. 3 is a perspective view of another exemplary prior art flexible frame pole 7 assembly having a coupler sleeve 11 having an attached rope ring 2 that is misoriented. As depicted it is easy to see how netting 4 may snag on the rope ring 2 when the draped netting encounters a misoriented rope ring 2 or some force moves the netting 4 into snagging engagement with the rope ring 2.

The depictions presented in FIGS. 1A-3 are presentations of prior art known to those skilled in the art. These depictions are of a representative structure that supports the covering on the framework; however, similar issues may arise with structures (such as tents and bullpen enclosures) that suspend the covering from a framework. And in some instances, a covering may be suspended from the framework (such as a tent) while another covering may be supported by the framework (such as a rain fly for the tent). Informed by this disclosure, those skilled in the art will be enabled to make and use the invention of this disclosure.

Figure 4:
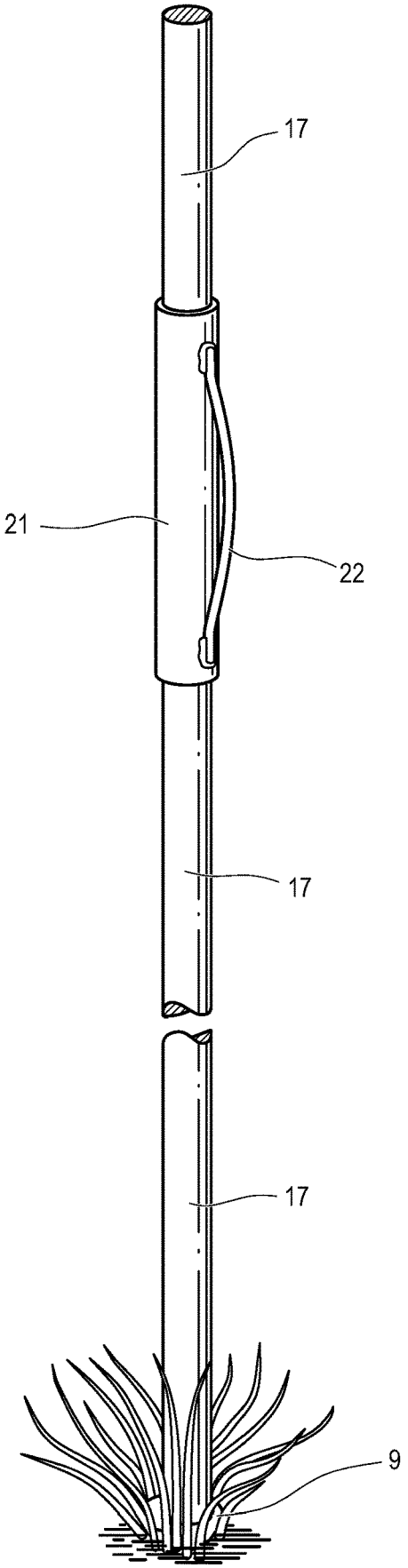
FIG. 4 is an elevational view of a flexible frame pole having a rigid coupler sleeve with an exemplary snag-free eyelet anchor secured to the coupler sleeve.

Beginning with FIG. 4, an elevational view of a flexible frame pole 17, the depictions in the remaining drawings show representative embodiments of the invention of this disclosure. The flexible frame pole 17 has a rigid coupler sleeve 21 with an exemplary snag-free eyelet anchor 22 secured to the coupler sleeve 21. An end of the one frame pole 17 (not necessarily the frame pole 17 with the coupler sleeve 21 attached) is planted securely into the ground. Removably inserted into the coupler sleeve 21 is another frame pole 17 which may or may not have a snag-free eyelet anchor 22. It should be understood that the frame pole 17 depicted could be a tent pole or a recreational pole such as, for example, might be used for a badminton net or any other structural pole (flexible or not) that may require an eyelet.

Figure 5A:
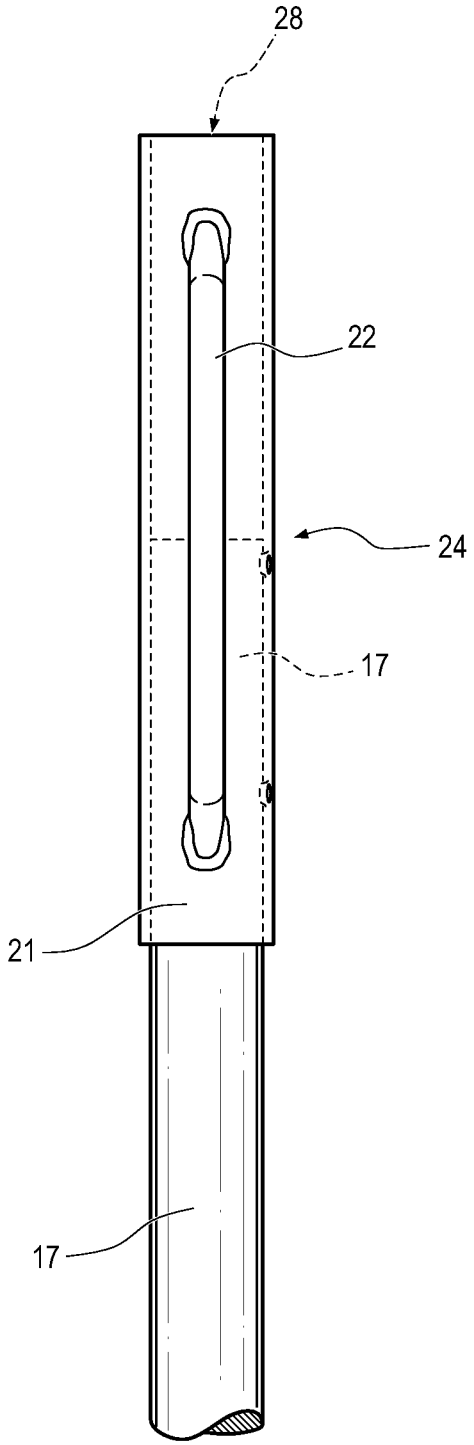
FIG. 5A is a top plan view of the flexible frame pole with a coupler sleeve and the exemplary snag-free eyelet anchor secured to the coupler sleeve.

FIG. 5A is a top plan view of the coupling end 24 of the frame pole 17 with a coupler sleeve 21 and the exemplary snag-free eyelet anchor 22 secured to the coupler sleeve 21. As depicted, the snag-free eyelet anchor 22 is aligned longitudinally along the longitudinal axis of the frame pole 17 and is affixed to the coupler sleeve 21 by welding, some other sufficiently strong bonding, riveting, or by any suitable means that does not present a snagging risk. Also, the configuration of the snag-free eyelet anchor 22 is smooth and rounded such that there are no sharp or rough edges or surfaces.

Figure 5B:
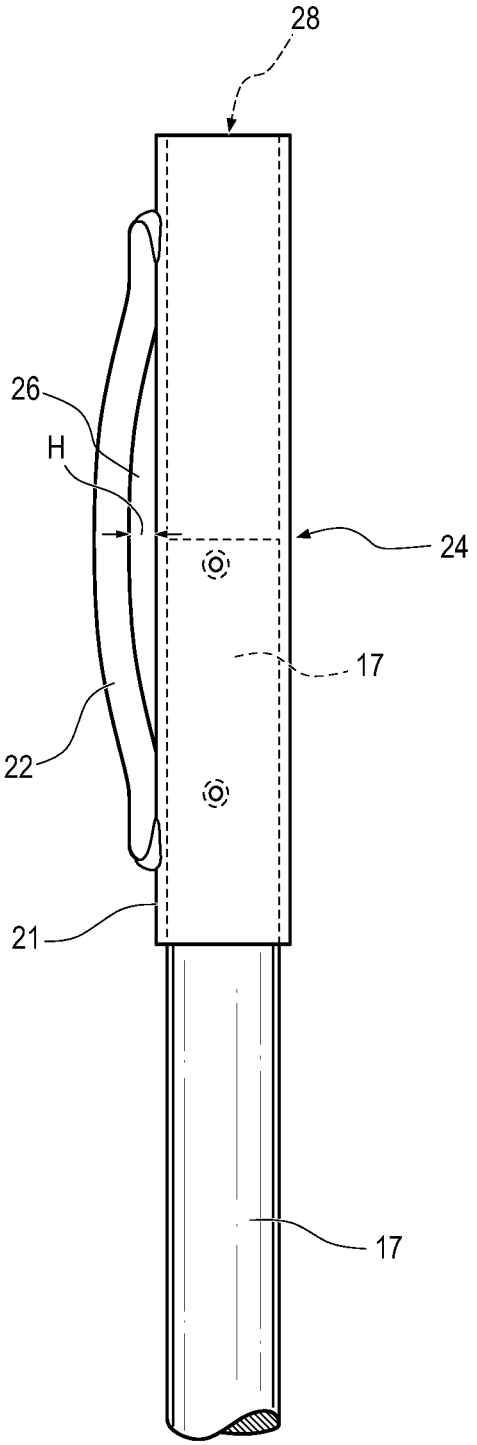
FIG. 5B is a side view of the flexible frame pole with a coupler sleeve and the exemplary snag-free eyelet anchor secured to the coupler sleeve showing an opening defined by the snag-free eyelet anchor as secured to the coupler sleeve.

FIG. 5B is a side view of the flexible frame pole 17 with a coupler sleeve 21 and the exemplary snag-free eyelet anchor 22 secured to the coupler sleeve 21 showing an opening 26 defined by the snag-free eyelet anchor 22 as secured to the coupler sleeve 21. Because the snag-free eyelet anchor 22 has a low-profile, arc shape, opening 26 is elongate and is low profile. A height H of opening 26 is shown where the distance between the snag-free eyelet anchor 22 and the coupler sleeve 21 is greatest. In the instance depicted, height H is at or near the center of the low-profile arc; it need not be so located. In fact, so long as the snag-free eyelet anchor 22 remains relatively low profile and no snag risk is presented the snag-free eyelet anchor 22 may have one or more gentle bumps that may increase the height H slightly and/or present a gentle nesting area for a rope, zip-tie, or the like. Height H needs only to be high enough to allow through the opening 26 whatever form of anchoring member is needed (rope, twine, wire, cord, clip, ring, etc.).

FIGS. 5A and 5B show, in phantom lines, a receiving recess 28 within the coupler sleeve 21 for receiving the non-coupler end of a frame pole 17. The force of bending connected flexible frame poles 17 (where the non-coupler end of one frame pole 17 is inserted into the receiving recess 28 of another frame pole 17) manifests at the coupler sleeve 21. The elongate, longitudinally oriented nature of the snag-free eyelet anchor 22 acts to reinforce the coupler sleeve 21 against such bending force exerted against the snag-free eyelet anchor 22.

Figure 6:
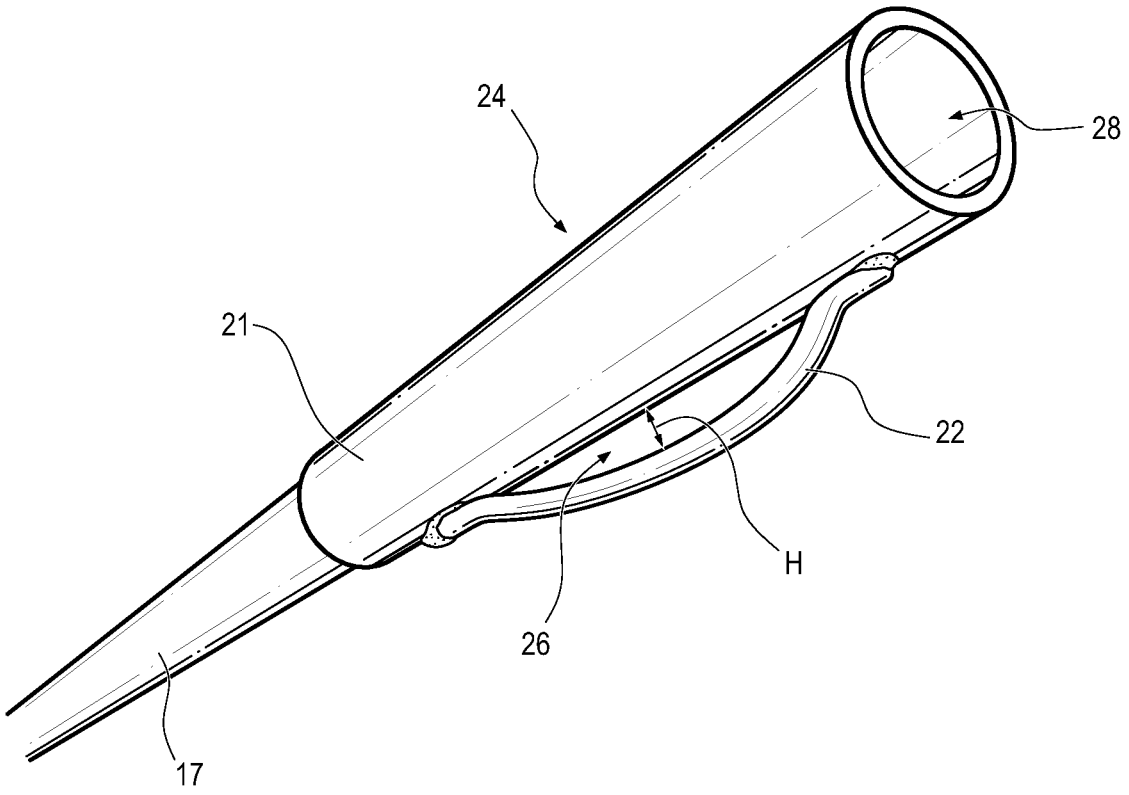
FIG. 6 is a prospective view of the flexible frame pole with a coupler sleeve and the exemplary snag-free eyelet anchor secured to the coupler sleeve showing a receiving recess of the coupler sleeve for coupling one flexible frame pole to another flexible frame pole.

A prospective view of the coupling end 24 of the frame pole 17 is depicted in FIG. 6. The depiction shows a coupler sleeve 21 with a snag-free eyelet anchor 22 and the receiving recess 28 of the coupler sleeve 21 for coupling one frame pole 17 to another frame pole 17.

Figure 7:
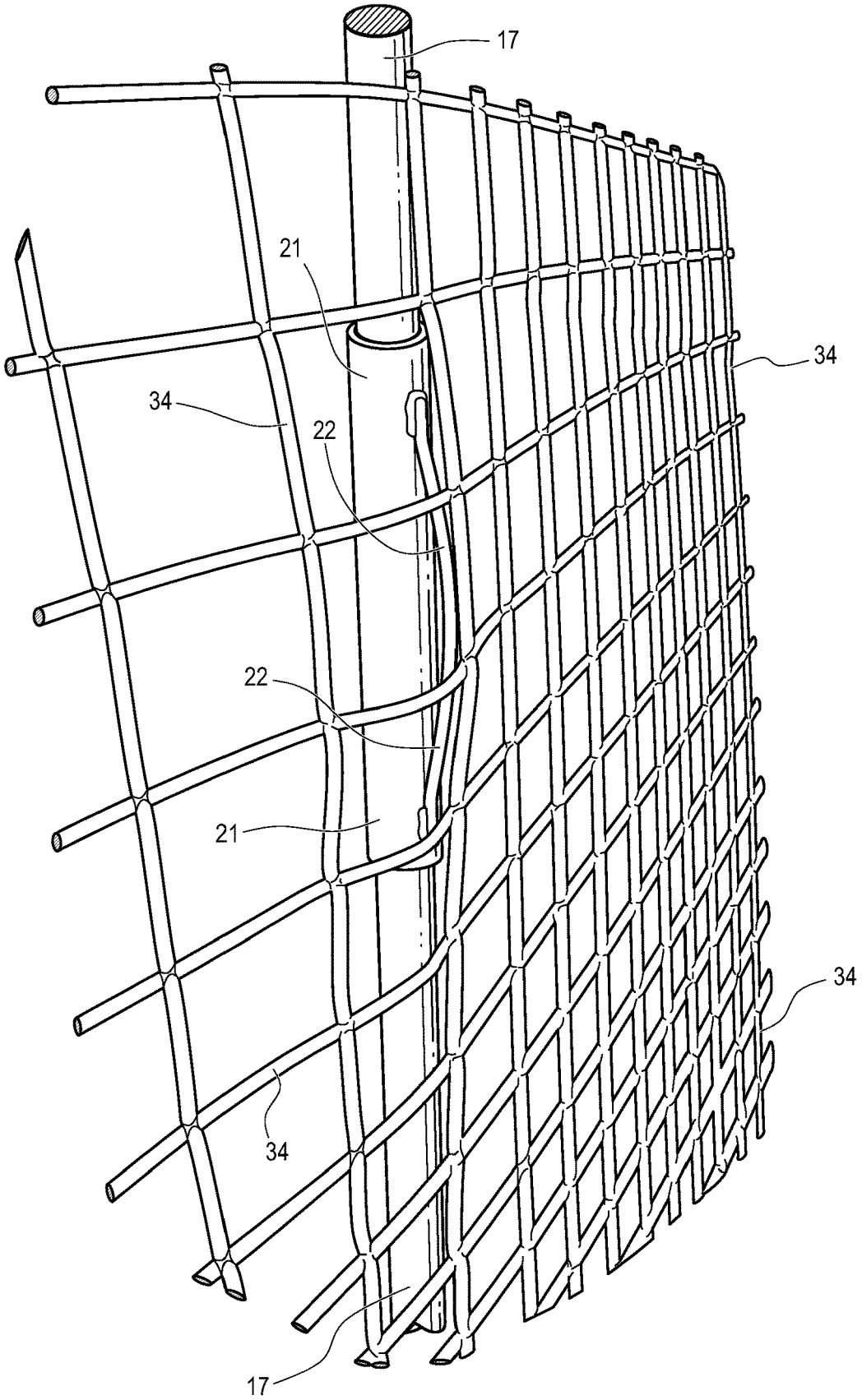
FIG. 7 is a perspective view of flexible frame poles coupled together and having the exemplary snag-free eyelet anchor of FIGS. 5A-6 depicting a snag-free encounter of the net with the snag-free eyelet anchor.

FIG. 7 is a perspective view of connected frame poles 17 having the exemplary snag-free eyelet anchor 22 of FIGS. 5A-6 depicting a snag-free encounter of the net 4 with the snag-free eyelet anchor 22. Such snag-free encounter may be the result of a misoriented snag-free eyelet anchor 22 (similar to the misoriented rope ring 2 discussed above regarding prior art) or in a brush-by of the netting 4 caused by the wind or an impact of an object on the netting 4. Due to the configuration and smoothness of the snag-free eyelet anchor 22, it is highly unlikely that the snag-free eyelet anchor 22 will present a snag situation with any type of covering (netting, lightweight materials, mesh or the like).

Figure 8A:
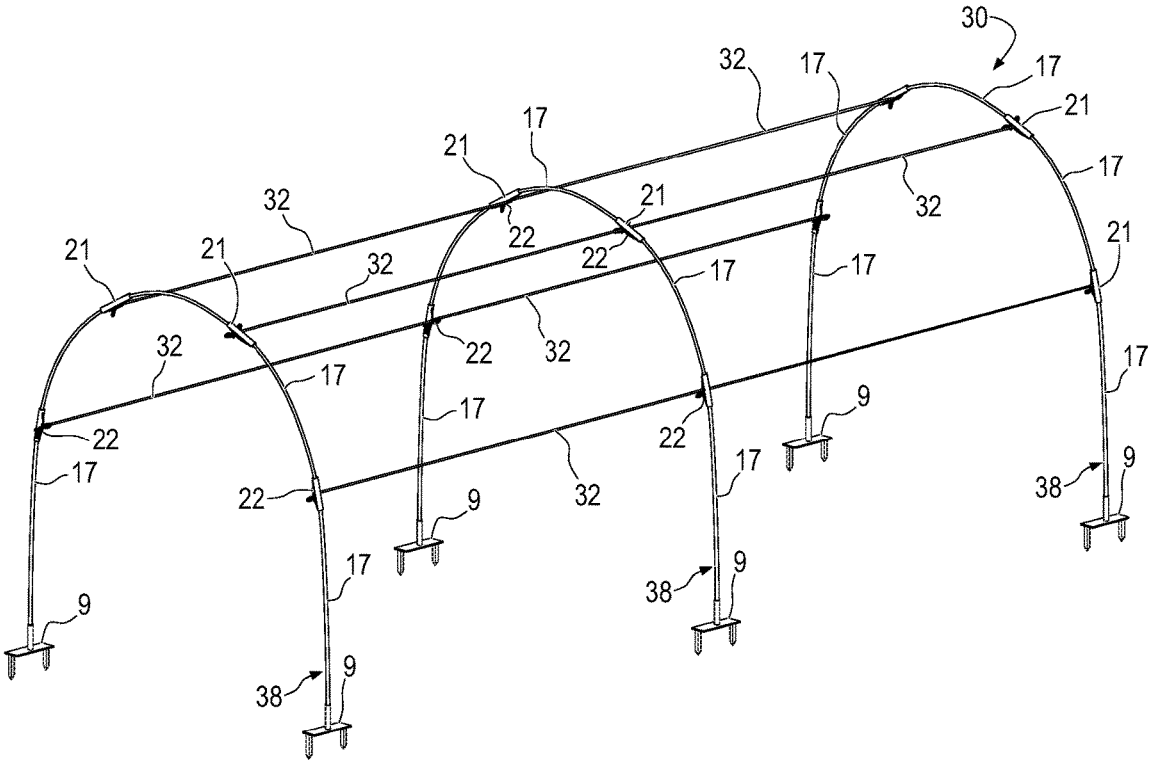
FIGS. 8A and 8B are perspective views of an exemplary batting cage framework during two stages of assembly.
Figure 8B:
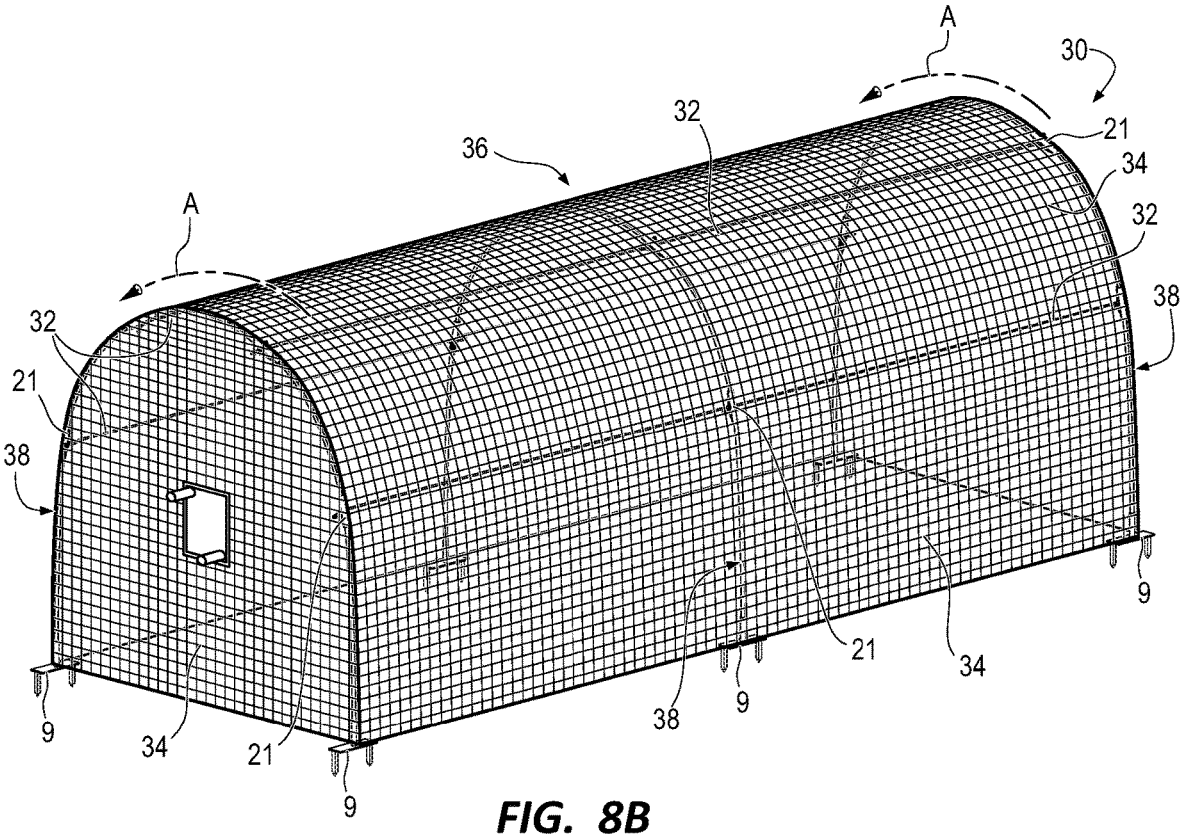

FIGS. 8A and 8B are perspective views of an exemplary representative batting cage framework 30 during two stages of assembly. FIG. 8A depicts a batting cage framework 30 showing snag-free eyelet anchors 22 positionally disposed along the framework 30 to receive exemplary guide ropes 32 that support and reinforce the shape of the framework 30. FIG. 8B shows netting 34 draped over the framework 30 and resting on the guide ropes 32 to define a batting cage enclosure 36.

Each snag-free eyelet anchor 22 is oriented inwardly into the batting cage enclosure. In this manner, the snag-free eyelet anchors 22 are unlikely to present snag situations with the netting 34 or with human skin or clothing: and additionally, the snag-free eyelet anchors 22 will reinforce the coupler sleeves 21 against the bending force presented by bending the frame poles into an archway 38.

Those skilled in the art will appreciate that the present embodiments are exemplary and representative and should not be limited to the embodiments shown and described.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A snag-free eyelet anchor assembly providing snag-free connection of flexible frame poles, the snag-free eyelet anchor comprising:

a coupler sleeve having a longitudinal axis, an outer surface, and a receiving recess for receiving and connecting flexible frame poles in coupling engagement, an elongate, low-profile arc-shaped body having a smooth and rounded snag-free configuration, the elongate, low-profile arc-shaped body being attached to the coupler sleeve such that the elongate, low-profile arc-shaped body aligns longitudinally with the longitudinal axis of the coupler sleeve, the elongate, low-profile arc-shaped body as attached to the outer surface of the coupler sleeve reduces snag risks to persons, clothing, and netting, and reinforces the coupler sleeve against bending force caused by bending connected flexible frame poles manifested and exerted against the snag-free eyelet anchor assembly and defines an opening between the elongate, low-profile arc-shaped body and the coupler sleeve, the opening being elongate and low-profile having a height being defined as the greatest distance between the elongate, low-profile arc-shaped body and the coupler sleeve along the longitudinal axis of the coupler sleeve.

2. The snag-free eyelet anchor assembly of claim 1, wherein the height of the opening allows an anchoring member to pass through the opening.

3. The snag-free eyelet anchor assembly of claim 2, wherein the anchoring member comprises a guide rope.

4. The snag-free eyelet anchor assembly of claim 1, wherein the elongate, low-profile arc-shaped body further comprises an attachment portion at each end of the elongate, low-profile arc-shaped body, each attachment portion having a length extending longitudinally along the outer surface of the coupler sleeve for attachment to the coupler sleeve along the length of the attachment portion.

* * * * *